United States Patent [19]

Perlberg et al.

[11] Patent Number: 4,823,960

[45] Date of Patent: Apr. 25, 1989

[54] PACKAGE DEVICE AND SYSTEM

[75] Inventors: William Perlberg, Franklin Lakes, N.J.; Albert B. Skolnik, New York, N.Y.

[73] Assignee: Hartz Mountain Corporation, Harrison, N.J.

[21] Appl. No.: 178,466

[22] Filed: Apr. 7, 1988

[51] Int. Cl.[4] ..... B65D 25/54

[52] U.S. Cl. ..... 206/587; 53/449; 206/45.34; 220/82 R; 220/410

[58] Field of Search ..... 206/45.31, 45.34, 470, 206/471, 485, 583, 587, 590–594; 220/4 D, 4 E, 82 R, 410; 53/449

[56] References Cited

U.S. PATENT DOCUMENTS

| | | | |
|---|---|---|---|
| 2,501,570 | 3/1950 | Larsen | 206/592 |
| 2,993,587 | 7/1961 | Stone et al. | 206/45.34 |
| 2,998,126 | 8/1961 | Jenkins | 206/45.34 |
| 3,370,697 | 2/1968 | Levey et al. | 206/45.34 |
| 3,451,536 | 6/1969 | O'Leary et al. | 206/45.31 |
| 3,476,282 | 11/1969 | Monaco et al. | 220/410 |
| 3,487,921 | 1/1970 | Barth et al. | 206/583 |
| 4,201,293 | 5/1980 | Rigazio et al. | 206/45.34 |
| 4,491,225 | 1/1985 | Baillod | 206/594 |
| 4,524,867 | 6/1985 | Klein et al. | 206/45.34 |

FOREIGN PATENT DOCUMENTS

| | | | |
|---|---|---|---|
| 2200710 | 7/1973 | Fed. Rep. of Germany | 206/45.34 |
| 2240024 | 2/1974 | Fed. Rep. of Germany | 206/45.31 |

*Primary Examiner*—Jimmy G. Foster

*Attorney, Agent, or Firm*—Kuhn and Muller

[57] ABSTRACT

A package device including a housing and a removably mounted insert support which enables the insertion, support and display of a vessel, e.g. a glass vessel containing a fragrance.

18 Claims, 4 Drawing Sheets

FIG. 1
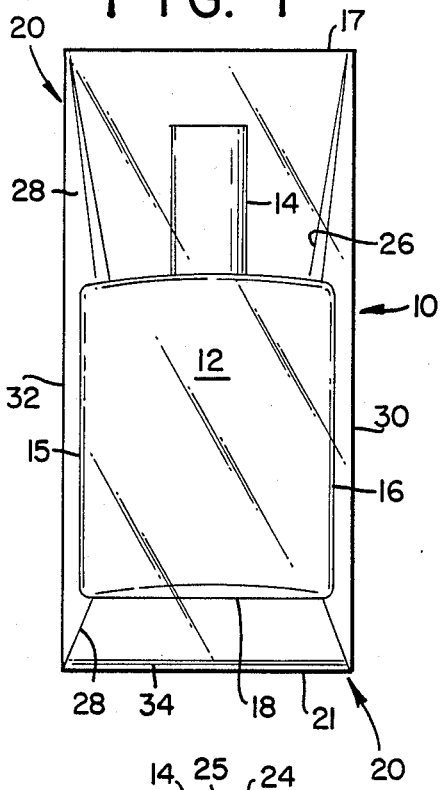
FIG. 1(b)
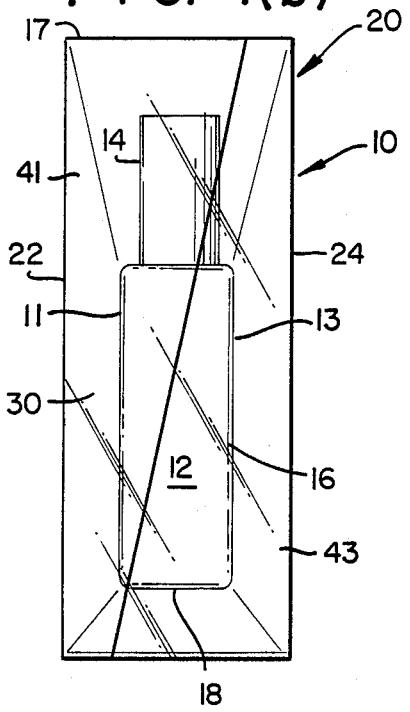
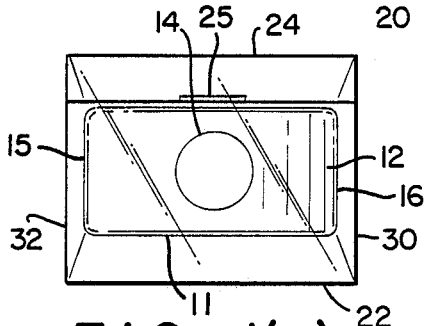
FIG. 1(a)
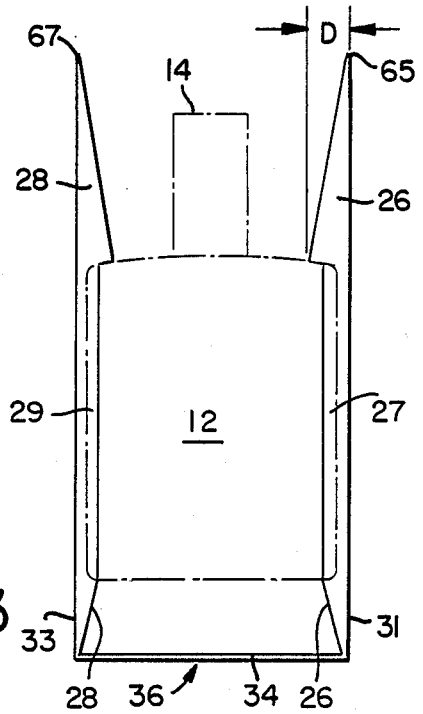
FIG. 3

FIG. 2
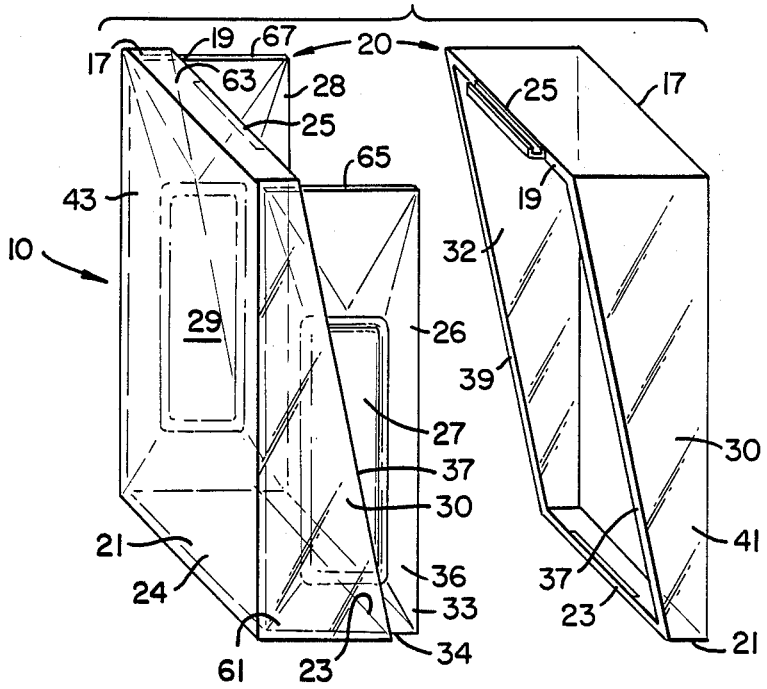
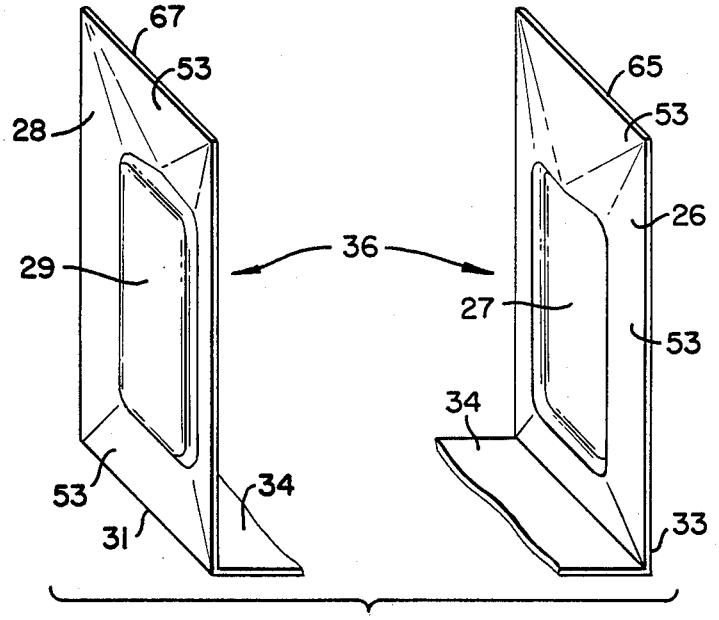
FIG. 3(b)

PACKAGE DEVICE AND SYSTEM

FIELD OF THE INVENTION

This invention is directed to a package device. More particularly, this invention is directed to a package device which includes a "see-through" housing in combination with a resilient, removable, transparent or translucent insert member of minimal visibility which provides support for a vessel within the "see-through" housing.

BACKGROUND OF THE INVENTION

In the field of packaging relatively expensive consumer items, such as fragrance containers, it has been a common practice to develop packaging which provides a high order of protection to the packaged item during shipment and customer handling while allowing as much visibility of the item as is consistent with the needed protection.

Notwithstanding many years of effort in this field, there is still a need to provide attractive, relatively low cost packaging for fragrance containers and the like which securely protect the container while enabling almost unrestricted viewability, i.e. visibility of the item.

It is accordingly an object of the present invention to provide secure packaging for relatively expensive consumer items such as bottled fragrance the like which enables virtually complete visibility of the item within the package.

It is another object of the invention to provide packaging for an item which enables viewability of the item from partically any line of sight.

It is a further object of the present invention to provide relatively low cost packaging for fragrance bottles and the like.

It is another object of the present invention to provide a packaged item supported within a "see-through" package.

It is a still further object of the present invention to provide a method for packaging a container.

SUMMARY OF THE INVENTION

A package device in accordance with the present invention comprises a "see-through" housing in combination with a snugly fitted but removable, translucent, resilient, insert having spaced-apart recesses for supporting a vessel within the housing, preferably in a position spaced away from all adjacent surfaces of the housing.

BRIEF DESCRIPTION OF THE DRAWINGS

For a further understanding of the present invention, reference may be had to the following drawings in which:

FIGS. 1, 1(*a*), and 1(*b*) show front, side elevation and top plan views, respectively, of a package device in accordance with the present invention;

FIG. 2 shows an exploded view, in isometric, of the package device of FIG. 1;

PREFERRED EMBODIMENTS OF THE INVENTION

Figure 4:
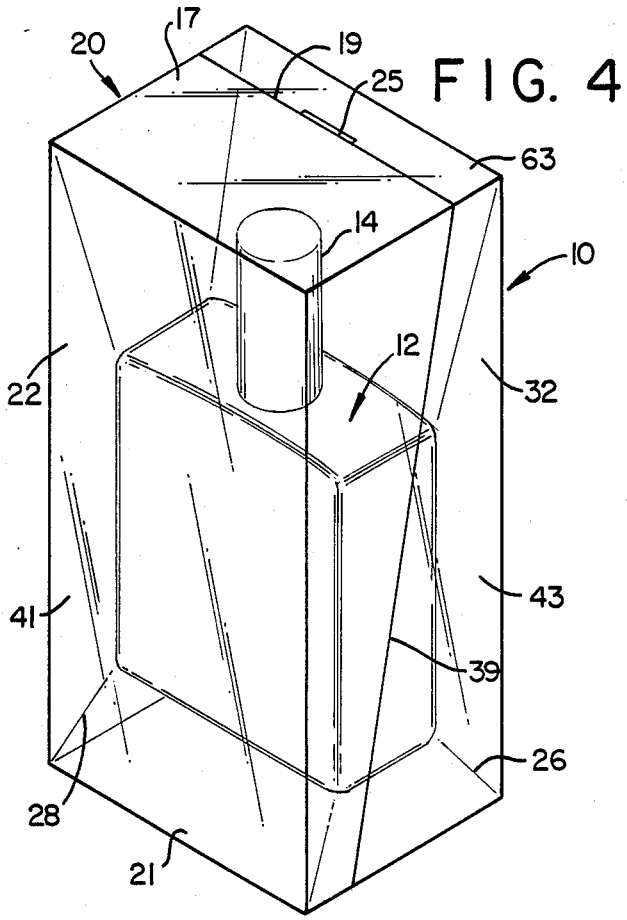
FIG. 4 is an isometric view of the package device of the present invention containing a vessel.

With reference to the drawings, and in particular to FIGS. 1 to 4, the package device of this invention is indicated at 10 enclosing a vessel 12, e.g. a transparent or opaque bottle containing perfume, other fragrances, or other products. The vessel 12 has a cap 14, side surfaces 15 and 16, front and back surfaces 11, 13 and a base 18.

The package device 10 includes a housing 20 having a "box shape" as shown in FIG. 1 of the drawing. In the preferred embodiment, housing 20 has substantially the shape of a right parallelepiped and is typically formed from two separable mating sections 41, 43 as will be described further hereinafter. The walls of housing 20 are formed typically from rigid thermoplastic material, e.g. polystyrene, polycarbonate, nylon, and the like, having a typical thickness of about 0.050 inch to 0.100 inch, and at least the front side or wall 22 and rear side or wall 24, and preferably all walls, top, bottom and sides, are "see-through", i.e. translucent and preferably transparent to permit viewability of vessel 12.

A pair of spaced apart, preferably resilient, shell-shaped inserts 26, 28 formed of translucent, preferably transparent, thermoplastic, such as polyvinylchloride, suitably having a thickness of from about 0.010 inch to 0.025 inch, are respectively arranged adjacent to side walls 30 and 32 of housing 20. The shell-shaped inserts 26, 28, which peripherally contact respective side walls 30, 32, have mutually opposed inwardly opening recesses 27, 29 shown particularly in FIGS. 3 and 3(b), which recesses extend only part way towards the adjacent housing side-wall and are adapted to snugly receive a container 12 therebetween. The inserts 26, 28 form the sides of U-shaped channel member 36 (FIG. 3(*b*)), and are arranged immobile with respect to adjacent side walls 30, 32 of the housing 20 as shown in FIG. 2 by virtue of base member 34 of channel shaped member 36 (FIGS. 3 and 3(*b*)). The base member 34 rests on housing bottom wall 21, and spaces apart the inserts 26, 28, and causes the lower portions thereof, 31, 33, (FIG. 3, 3(*b*)) to bear against side walls 30, 32, of housing 20. The sizing of inserts 26, 28 to be substantially coextensive in length and width with side walls 30, 32 causes channel member 36 to fit snugly in and be essentially immobile in housing 20 when container 12 is in place within recesses 27, 29.

Figure 5A:
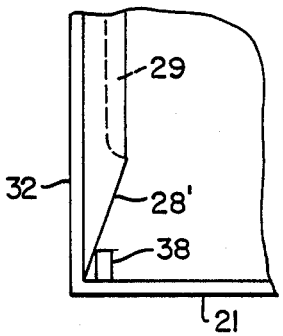
FIGS. 5(*a*) and 5(*b*) show alternate arrangements for the insert element.
Figure 5B:
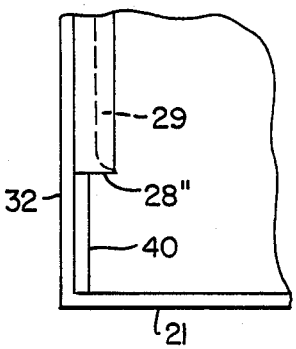

Alternative arrangements to achieve immobility of inserts 26, 28 without employing a U-shaped channel shaped member are shown in FIG. 5(*a*) and FIG. 5(*b*). FIG. 5(*a*) shows a groove arrangement 38 which avoids the need for the base member 34 of U-shaped channel 36 shown in FIG. 3; FIG. 5(*b*) shows a stand-off arrangement 40 which enables the use of inserts which are not coextensive in length with the side walls 30, 32 of housing 20.

Figure 3A:
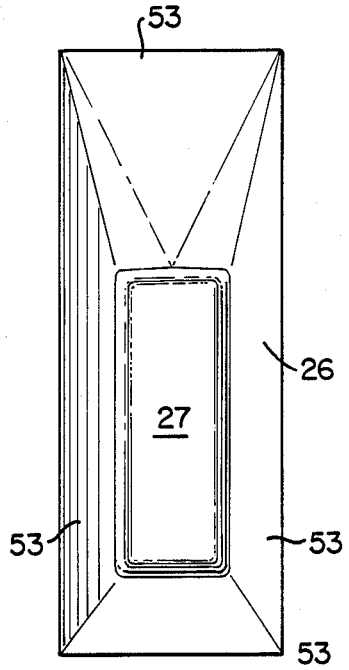
FIGS. 3, 3(*a*) and 3(*b*) show views of the insert element of the package device of FIG. 1.

In accordance with the parking method of the present invention, and with reference to FIGS. 2 to 4, a container, e.g. fragrance containing bottle 12, is positioned to nest in recesses 27, 29 of inserts 26, 28 which conform to the lateral shape and bottom side edges of the bottle. The container 12 together with inserts 26, 28 which form the sides of U-shaped channel number 36 is placed in housing 20 adjacent side walls 30, 32, respectively.

To facilitate this procedure, housing 20 is formed of two separable mating parts 41, 43, for example as shown in FIG. 2. The mating edges of mating parts 41, 43 are located in the top housing wall member 17, as indicated at 19, in bottom housing wall member 21 as indicated at 23, and in side walls 30 and 32 adjacent inserts 26, 28 as indicated at 37, 39. A conventional snap clasp 25 (FIGS. 2 and 4) can be used to hold the mating parts 41, 43 of housing 20 in place. Container 12 is readily removed from housing 20, without the necessity of removing inserts 26, 28, and can be readily replaced due to the resilience of inserts 26, 28 which are resiliently deflectable inwardly towards their respectively adjacent side walls. With reference to FIG. 2, the preferred embodiment of the housing 20 comprises mating housing component parts 41, 43 with the bottom 61 of housing part 43 forming a major portion, e.g., more than about fifty percent, suitably 75–95 percent, of the surface of housing bottom wall member 21, and the top 63 of housing part 43 forming a minor portion, e.g., less than about fifty percent suitably 5–25 percent, of the surface of housing top wall member 17. With the aforedescribed arrangement, the placement of inserts 26, 28 of U-shaped channel 36 with a container 12 held resiliently therebetween, as shown in FIG. 3, in housing part 43 as shown in FIG. 2, results in a stable engagement of inserts 26, 28 with housing part 43. More than half of the surface of base member 34 is supported by the bottom 61 of housing part 43, and the top 63 surface of housing part 43 closely contacts the top edges 65, 67 of inserts 26, 28, thus eliminating the possibility that inserts 26, 28, and container 12 could fall out of housing part 43 before closure of housing 20 by engagement of mating housing part 41.

By virtue of the resilience of inserts 26, 28 and a slight oversizing of the dimensions "D" shown in FIG. 3, the container 12 resiliently deforms inserts 26, 28 when the inserts and vessels are directed into housing 20. As a result, container 12 is held firmly and resiliently in housing 20 and due to the location of recesses 27, 29, container 12 is preferably spaced away from all side wall surfaces and the top and bottom walls of housing 20 as shown in FIG. 4. Consequently, in this embodiment of the invention the bottle 12 appears to be levitated, and by tilting and rotating housing 20, a virtually complete viewing of the bottle 12 from practically any line of sight can be obtained while the impression of levitation is maintained. This effect, and the viewability of the bottle 12 may be enhanced by avoiding sharp bends and edges in the concave surfaces of inserts 26, 28 and in the recesses 27, 29. By providing facets 53 (FIG. 3(b)) on the surfaces of inserts 26, 28 there is some deflection of light and the "see-through" and "levitation" effects are enhanced.

The preferred optical properties of the housing and inserts include a high value of luminous transmittance of 90% or more—Society of the Plastics Industry (SPI) Classification—(ASTM D 791).

The preferred housing material has a high modulus of elasticity in tension, e.g. 450,000 psi and even higher, to ensure that the housing holds its shape during use; the preferred insert material has a lower modulus of elasticity in tension, e.g. up to 25% lower to ensure that it is sufficiently flexible and resilient to receive the vessel to be enclosed in the housing yet is sufficiently supportive thereof against damage during storage, shipping and handling.

Figure 6:
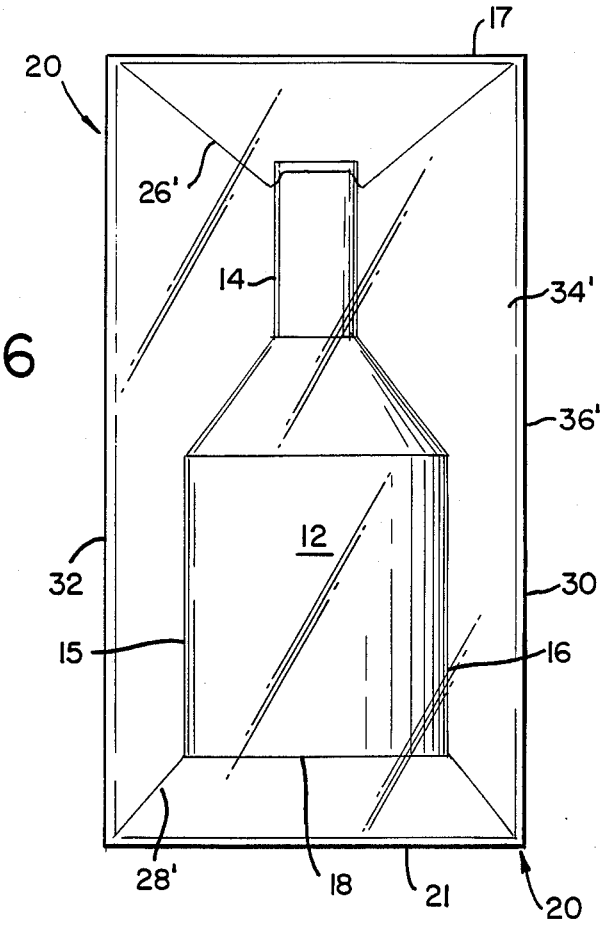
FIGS. 6 and 6(a) show a front view and top view, respectively, of an alternate package device in accordance with the invention.
Figure 6A:
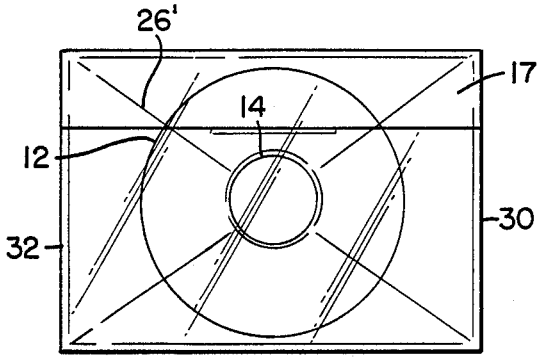

In addition to the embodiments particularly described, the housing 20, instead of being box-like in shape, can have curved opposing sides and top and bottom members or the insert members can be adapted to engage the front and back of the container, or the top and bottom of the container. Also, the recessed portions of the respective insert members need not be identical and will be different if the container involved is not symmetrical or if the inserts are to engage the top and bottom of a container instead of the sides. Such an alternative embodiment is shown in FIGS. 6 and 6(*a*), wherein insert 26' has been modified in shape to resiliently engage the circular cross-section top 14 of a round container 12 and insert 28' has been modified in shape to resiliently engage the round base 18 of container 12. In this embodiment channel shaped member 36' includes the dissimilarly shaped inserts 26' and 28' which are connected by channel "base" member 34'.

What is claimed is:

1. A package device for supporting and displaying a vessel, said packaging device comprising:

(a) a housing having (i) a first pair of two opposed, rigid, spaced-apart translucent side walls (ii) a second pair of two opposed, rigid, spaced-apart side walls juxtaposed to said first pair and (iii) opposed, rigid, spaced-apart top and bottom walls;

(b) a pair of spaced apart removable inserts formed of resilient translucent material arranged to be immobile and adjacent respective opposed walls of said housing, each of said inserts having a generally concave surface extending away from the housing wall to which it is adjacent, and mutually opposed inwardly opening recesses in their respective generally concave surfaces to receivably support a vessel within said housing, said inserts being opposing sides of a channel shaped member, said channel shaped member having a bottom member which is arranged to be adjacent and immobile with respect to the wall of the housing extending between the walls adjacent the spaced apart inserts.

2. A package device in accordance with claim 1 wherein said housing is box-like in shape and said inserts are shell-like in shape.

3. A package device in accordance with claim 1 wherein the recess in an insert extends only part of the distance from the concave surface of the insert to the wall to which it is adjacent.

4. A package device in accordance with claim 1 wherein the housing and the inserts are formed substantially entirely of transparent material.

5. A package device in accordance with claim 1 wherein the opposed recesses in said concave surfaces are spaced away from all of the side walls of the housing and from the top and bottom walls of the housing so that a vessel receivably supported by said recesses is also spaced away from all of the side walls and from the top and bottom walls of the housing.

6. A package device in accordance with claim 1 wherein said housing is openable and is formed of two separable mating parts, each said parts having mating edges in the top and bottom walls of the housing and in the first pair of two opposed spaced-apart side walls.

7. A package device in accordance with claim 1 wherein the insert material is formed from sheet material having a thickness substantially less than the thickness of the walls of the housing.

8. A package device in accordance with claim 1 which includes in combination a vessel receivably supported in said recesses and wherein said recesses have a shape which closely conforms to the contacting surfaces to said vessel.

9. A package device in accordance with claim 1 wherein the generally concave surface of each insert is shaped to have a plurality of facets.

10. A package device in accordance with claim 1 wherein the walls of the housing are all substantially rigid and are formed of a thermoplastic material.

11. A package device in accordance with claim 1 wherein said inserts are formed of a thermoplastic material.

12. A packaged item supported and displayed within a see-through type package comprising:

(a) a housing formed of rigid thermoplastic material having (i) a first pair of two opposed, spaced-apart translucent side walls (ii) a second pair of two opposed spaced-apart side walls juxtaposed to said first pair and (iii) opposed spaced-apart top and bottom walls;

(b) a pair of spaced apart resilient removable inserts formed of thermoplastic translucent material arranged within said housing to be immobile thereon and adjacent respective opposed walls of said housing, each of said inserts having a generally concave surface extending away from the housing wall to which it is adjacent, said inserts having mutually opposed recesses in their respective generally concave surfaces to receivably support a vessel within said housing, and (c) a vessel positioned between said inserts and nesting in the recesses of each of said inserts and establishing a resilient deformation of each of said inserts to cause each of said inserts to bear against the housing side wall adjacent thereto.

13. A package item in accordance with claim 12 wherein the housing and the inserts are formed substantially entirely of transparent material.

14. A package item in accordance with claim 12 wherein said resilient inserts are arranged within said housing adjacent respective opposed side walls of said housing.

15. A method of packaging a vessel comprising:

(a) providing a pair of spaced apart removable inserts formed of resilient translucent thermoplastic material, each of said inserts having a generally concave surface and having mutually opposed recesses in their respective generally concave surfaces;

(b) providing a housing formed of rigid thermoplastic material having (i) a first pair of two opposed, spaced-apart translucent side walls (ii) a second pair of two opposed spaced-apart side walls juxtaposed to said first pair and (iii) opposed spaced-apart top and bottom walls;

(c) arranging a vessel between the spaced apart resilient, translucent thermoplastic inserts outside of said housing so that the vessel is receivably supported in the mutually opposed recesses of the inserts;

(d) directing the pair of spaced apart resilient inserts with the vessel receivably supported thereby into the housing in a direction such that each of said inserts is adjacent a respective side wall of said second pair of side walls and resiliently bears against said side wall to hold said vessel immobile in said housing.

16. A method of packaging a vessel in accordance with claim 15, wherein said housing is openable and is formed of two separable mating parts, each of said parts having mating edges in the top and bottom walls of the housing and in the first pair of two opposed spaced apart side walls and wherein the spaced apart inserts are the opposing sides of a channel shaped member, said channel shaped member having a bottom member which is substantially coextensive with the bottom wall of the housing.

17. A method of packaging a vessel in accordance with claim 16, wherein a first part of said separable mating parts forming said housing has a bottom which forms a major part of the bottom wall of the housing and a top which forms a minor part of the top wall of the housing and wherein said channel shaped member is directed into the first mating part forming said housing such that the bottom member of the channel shaped member is supportably contacted by the bottom of the first part of said separable mating parts.

18. A package device for supporting and displaying a vessel, said packaging device comprising:

a housing having a first pair of two opposed, rigid, spaced apart translucent side walls, a second pair of two opposed, rigid, spaced apart side walls juxtaposed to said first pair and opposed, rigid, spaced apart top and bottom walls;

a pair of spaced apart removable inserts formed of resilient translucent material arranged to be immobile and adjacent respective opposed walls of said housing, each of said inserts having a generally concave surface extending away from the housing wall to which it is adjacent, and mutually opposed inwardly opening recesses in their respective generally concave surfaces to receivably support a vessel within said housing, said housing being in the shape of a right parallelipiped and said spaced apart inserts being the opposite sides of a channel shaped member having a bottom member which is substantially coextensive with the bottom wall of the housing and is supportably contacted by the bottom wall of the housing.

* * * * *